US006187144B1

(12) United States Patent
Ketola et al.

(10) Patent No.: US 6,187,144 B1
(45) Date of Patent: Feb. 13, 2001

(54) METHOD FOR SIZING PAPER

(75) Inventors: Hannu Ketola, Hämeenlinna; Tuija Andersson; Asko Karppi, both of Turku; Sauli Laakso, Masku; Antti Likitalo, Turku, all of (FI)

(73) Assignee: Raisio Chemicals Oy, Raisio (FI)

( * ) Notice: Under 35 U.S.C. 154(b), the term of this patent shall be extended for 0 days.

(21) Appl. No.: 09/053,644

(22) Filed: Apr. 2, 1998

Related U.S. Application Data

(63) Continuation-in-part of application No. 08/845,475, filed as application No. PCT/FI98/00095 on Apr. 25, 1997, now abandoned.

(30) Foreign Application Priority Data

Jan. 31, 1997 (FI) ..... 970422

(51) Int. Cl.[7] ..... D21H 11/00

(52) U.S. Cl. ..... 162/175; 162/198

(58) Field of Search ..... 162/175, 198

(56) References Cited

U.S. PATENT DOCUMENTS

| | | | | |
|---|---|---|---|---|
| 3,017,294 | * | 1/1962 | Meisel | 162/175 |
| 3,336,292 | * | 8/1967 | Kirby | 162/175 |
| 3,448,101 | * | 6/1969 | Billy et al. | 162/175 |
| 4,127,563 | * | 11/1978 | Rankin et al. | 162/175 |

* cited by examiner

*Primary Examiner*—Christopher A. Fiorilla
(74) *Attorney, Agent, or Firm*—Pollock, Vande Sande & Amernick

(57) ABSTRACT

A method for internal sizing of paper using cationic starch is provided. The starch used is cationized with a mixture of epichlorhydrin, trimethylamine, and mono-or dimethylamine or N,N,N',N'-tetramethylethylenediamine. Cationizing results in a higher molecular size of the starch, which has e.g. a beneficial effect on dewatering on the paper machine forming wire.

12 Claims, 3 Drawing Sheets

METHOD FOR SIZING PAPER

CROSS-REFERENCES TO RELATED APPLICATIONS

The present application is a continuation-in-part of copending application Ser. No. 08/845,475, entitled "Method for Sizing Paper" filed Apr. 25, 1997 as a 371 application of PCT/FI98/00095 dated Apr. 25, 1997 and now abandoned.

STATEMENT REGARDING FEDERALLY-SPONSORED RESEARCH OR DEVELOPMENT

Not Applicable

BACKGROUND OF THE INVENTION

1. Field of the Invention

The invention concerns the sizing of paper in connection with its manufacture using a so called internal sizing technique. As a sizing chemical starch is used which is provided with special properties, whereby it better meets the requirements of the modern paper manufacture than the conventional internal sizing starches (wet-end starches).

2. Description of Related Arts

Starch is a natural polymer, which consists of glucose monomers bonded by 1,4-α-D-glucoside bonds to each other. Each glucose monomer contains three free hydroxyl groups capable of forming hydrogen bonds. When starch is solubilized in water, which is achieved by heating an aqueous starch slurry, i.e. by cooking, a viscous solution is produced, in which the viscous character results from hydrogen bonds between water and starch hydroxyl groups, and depends on the molecular size of the starch. When such a starch gel is dried, water is repelled from the spaces between the hydroxyl groups, and the hydrogen bonds are formed directly between the starch chains and the fibers forming the paper. This kind of hydrogen bond is stable and is responsible for the sizing property of starch.

Natural starch is weakly anionic by its nature, similarly to the fibers and fillers used in paper manufacture. Thus, when starch is added to the paper pulp, fixation of the starch to the fibers is negligible, and consequently in the filtration step connected with the sheet forming, i.e. in the dewatering step of the paper manufacture process, the natural starch is flushed away with water. The retention of starch is weak on the paper machine forming wire. For improving the retention, natural starch is chemically modified to expose cationic properties by bonding etherically thereto a quaternary nitrogen containing reagent. The cationicity of the cationic starches is expressed as a molar ratio between the substituted (cationic) glucose units and all the glucose units, i.e. as a degree of substitution.

Cationic internal sizing starches form the most frequently used group of chemical additives which increase the dry strength in paper manufacture. The starch used for the manufacture of the internal sizing starch may originate from potato, cereals or tapioca. The most commonly used raw material is potato starch. The use of internal sizing starches is disclosed for instance in the book of James P. Casey (Ed.), Pulp and Paper Chemistry and Chemical Technology, 3th Edition, Volume III, Chapter 14, Natural Products for Wet-End Addition, 1981, pp. 1475 to 1514.

The aim in modern paper manufacture is to increase the speeds of the paper machines. This leads to the requirement of providing good dewatering properties on the paper machine forming wire. Effective dewatering leads in turn to new requirements for the retention of fibers, fillers and internal sizing starches on the wire. The increase in the machine speed sets also greater demands on the paper strength. Especially the former-type paper machine wire parts, by which the dewatering efficiency has been attempted to be increased, put new demands on the strength of the paper in the z-direction. Starch has an important role in the strengthening of the paper in this direction.

As mentioned above, starch is a hydrocolloid with a water bonding capacity. On the other hand, a cationized starch is also a cationic polymer, which, due to the cationic character, has the property to increase dewatering so, that the higher the degree of cationicity the higher the dewatering. When starch is administered in the paper machine wet-end, the dewatering is increased at the beginning as long as the amounts added are smaller, but when the administered amounts are higher, the water binding capacity of the starch overrides the benefit received from the higher cationicity, and the dewatering capacity of the paper machine is decreased. This is what happens especially when lower cationic starches are used, whereby the dewatering often tends to limit the paper machine speed. The paper machine speed can be increased if the efficiency of the starch can be improved either so that smaller amounts are required or so that the water binding capacity of the starch can be lowered without affecting the strength properties.

One possibility to increase the dewatering properties of cationic starches is to increase the cationicity. As far as the cationicity is concerned, the present slurry processes are capable of achieving a degree of substitution of 0.05 without problems in the solubility of the starch. In order to achieve products with a higher cationic charge, dry cationizing processes are to be used. A disadvantage of these cationizing processes is the purity of the products, which is lower than the purity achieved by the slurry processes. Another feature, which limits the possibility to increase the degree of cationicity is the dosage of the starch which cannot be very high without the risk of a too high cationic charge in the stock flow, as easily happens for starches with a high cationic charge. At lower doses a lower strength must be accepted, as the strengthening effect is directly proportional to the starch content in the paper.

As an increase in the degree of cationicity does not as such lead to the intended result, another solution for increasing the efficiency of a cationic starch has to be found. One possibility is a further modification of the cationic starch. A common procedure in the manufacture of cationic surface sizes is oxidative degradation of the starch chains. Although this procedure would have positive influences on the dewatering on a paper machine, a decrease in starch retention would obviously be the result if applied on internal sizing, because the proportion of cationic groups in an individual starch molecule would be lower. In order to increase the retention, a higher degree of cationicity would be required. According to common knowledge, the starch molecules are to be maintained as intact as possible in an internal sizing starch. This pertains also to starch treatment in the paper mill, where a too vigorous cooking or pumping may degrade the starch chains.

Consequently, substantially the only possibility to try to change the properties of cationic starches is to increase the molecular size of the natural starch.

This approach is taken when crosslinked cationic starches are used in paper manufacture, U.S. Pat. No. 5,122,231 and EP-A1-0 603 727. Problems relating to the manufacture and use are, however, involved in these known methods. When using these modification processes, the crosslinking must be performed in a separate process step. The starch produced in this way also requires special cooking conditions in order to be in a suitable form for addition to the paper. The aforementioned citations do not disclose any information of manufacturing a cross-linked starch using dry cationizing methods.

Products for cationizing starches are commercially available, of which e.g. the product developed by Raisio Chemicals (henceforth "commercial cationizing chemical") is produced by using trimethylamine and epichlorhydrin. In connection with the development of this cationizing chemical it has been found, according to a special feature of the invention, that when the reactive trimethylamine also contains a mono- and/or dialkylamine, the resulting cationizing chemical has properties which increased significantly the viscosity of the starch in the cationizing step. As the viscosity of the starch is mainly dependent on molecular size, it can be assumed that the products thus obtained have a higher molecular size. It has also been recognized that these products can well resist cooking by direct steam, which presently is the most common procedure for dissolving starch in paper mills. When used as internal sizing agents, the cationized starches produced in this way have also proven to function effectively as retention agents, and they have a beneficial effect on dewatering.

However, the use of a mono- and dimethylamine causes problems in carrying out the invention. The produced cationizing chemical has a certain effect on the molecular size of starch, which effect results from these compounds. However, a cationizing chemical is primarily used for achieving a certain degree of cationicity in starch, i.e. a certain amount of cationizing chemical is used per certain amount of starch. In this way, the effects of the cationizing chemical on the degree of cationicity and on the molecular size are interdependent with each other. Alternatively, in order to achieve a certain degree of cationicity and a certain molecular size, a different cationizing chemical for each purpose should be prepared, in which the proportion of the epichlorhydrin to the amount of mono- and/or dimethylamine would be chosen according to the intended degree of cationicity and molecular size, respectively.

BRIEF SUMMARY OF THE INVENTION

During the development of the embodiments of the invention, the objective has been to find a compound which could modify starch correspondingly but would have better processing properties in the preparation of a cationizing chemical, or by which the degree of cationicity and molecular weight could be regulated more easily in cationizing. N,N,N',N'-tetramethylethylenediamine (TMEDA) has been found to be such a compound. A starch which is cationized with a chemical produced by using trimethylamine, N,N,N',N'-tetramethylethylenediamine and epichlorhydrin has been found to function as an internal sizing starch in paper manufacture similar to a starch which is cationized with a chemical produced by using trimethylamine, mono- and/or dimethylamine and epichlorhydrin.

DETAILED DESCRIPTION OF INVENTION

Figure 1A:
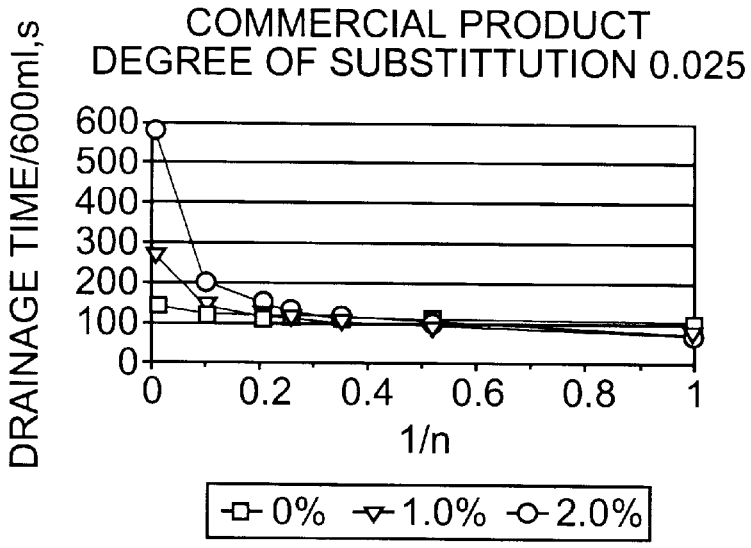
FIG. 1A PRIOR ART
FIGS. 1A, 1B, 2A, 2B, 3A and 3B illustrate dewatering tests with recirculated water.

It has also been ascertained that when N,N,N',N'-tetramethylethylenediamine is reacted with epichlorhydrin, a stable product is obtained which can be added to the commercial cationizing product consisting of trimethylamine and epichlorhydrin. By choosing the amount to be added, the intended molecular weight in cationizing can be chosen independently of the intended degree of cationicity.

In conclusion, the cationizing chemical can be one of the following:

1) The reaction product of trimethylamine, mono- and/or dimethylamine and epichlorhydrin.
2) The reaction product of trimethylamine, N,N,N',N'-tetramethylethylenediamine and epichlorhydrin.
3) The combination a+b, in which
   a=the reaction product of trimethylamine and epichlorhydrin, and
   b=the reaction product of N,N,N',N'-tetramethylethylenediamine and epichlorhydrin.

The cationizing reaction as such, during which also further modifications take place, is accomplished in a slurry of water and starch, at an elevated pH and temperature using the afore mentioned cationizing chemical and technology known per se. The said process is described for instance in the book of D. B. Solarek, Modified Starches: Properties and Uses, Chapter 8, Cationic Starches, 1986, pp. 113 to 129. Another possibility is to use the known dry cationizing technique, in which the cationizing chemicals are added to the essentially dry starch. The dry cationizing is described on page 118 of the afore mentioned book.

The invention can be described on the basis of the following examples.

EXAMPLE 1

This example describes the preparation of the separate component which is added to the commercial cationizing chemical.

3200 g (27.5 mol) of N,N,N',N'-tetramethylethylenediamine was dissolved in 24.0 kg of water. To the resulting solution 5853 g (63.3 mol) of strong (37.7%) hydrochloric acid was added so that the temperature remained under 35° C. during the addition. To the resulting solution 5634 g (60.6 mol) of epichlorhydrin was added so that the temperature remained under 35° C. during the addition. The mixture was heated to 35° C. for 20 h. Then the mixture was stripped in order to remove epichlorhydrin and 1,2-dichlor-2-propanol. In this way 15000 g of a cationizing chemical was obtained which had the following characteristics: dry content (Karl Fischer) 60%, viscosity (Brookfield, spindle No. 3) 200 mPas.

It can be noted that the principle in the preparation of this separate component is that one molecule of N,N,N',N'-tetramethylethylenediamine is reacted stoichiometrically with two molecules of epichlorhydrin. This reaction is preferably carried out by using a molar ratio of 2.3 between epichlorhydrin and N,N,N',N'-tetramethyl-ethylenediamine, as is evident from the table below. An applicable molar ratio is about 1.5 to 3.0.

| Molar ratio Epichlorhydrin/ TMEDA | Equivalents of reacted chlorhydrin in proportion to TMEDA |
|---|---|
| 2.0 | 1.7 |
| 2.1 | 1.8 |
| 2.2 | 1.9 |
| 2.3 | 2.0 |
| 2.5 | 2.0 |

EXAMPLE 2

This example describes the preparation and properties of the starches which are useful in the process according to the invention. In the example, the preparation of three products with a different degree of substitution is disclosed.

1200 g of commercial potato starch was slurried into 1200 ml of water. The slurry was heated to 40° C. and its pH was raised up to 11 with a dilute NaOH solution. To the solution was added a) 42 g of a commercial cationizing chemical (having an activity of 70%), to which 0.3 g of the reagent prepared in example 1 was added; b) 58 g of a commercial cationizing chemical (having an activity of 70%), to which 0.3 g of the reagent prepared in example 1 was added; c) 75 g of a commercial cationizing chemical (having an activity of 70%), to which 0.3 g of the reagent prepared in example 1 was added. The reaction was allowed to proceed for 24 h, whereafter it was neutralized, filtered and dried. In this way three different cationic starches with the equal degree of substitution as with the commercial reference products, i.a. 0.025, 0.035 and 0.045, could be produced.

When the above prepared products were cooked at a dry matter content of 5% in a laboratory-scale jet cooker with direct steam at a temperature of 135° C. and compared to similarly cooked, corresponding commercial products, the viscosities given below in Table 1 were obtained. Measurements were made at a temperature of 60° C.

TABLE 1

| Degree of substitution | Commercial product | New product |
|---|---|---|
| 0.025 | 130 mPas | 1200 mPas |
| 0.035 | 130 mPas | 1500 mPas |
| 0.045 | 370 mPas | 2300 mPas |

From the values obtained it is seen that the viscosity of the cationized starches prepared according to the invention is considerably higher, and thus they better stand cooking conditions and have a larger molecular size.

The dosage of the further modifying reagent (a reaction product of N,N,N',N'-tetramethylethylene and epichlorhydrin) depends on the desired viscosity of the end product. It has been found that internal sizing starch has the intended improved properties if it after cationizing has a degree of viscosity of over 1000 mpas measured with a Brookfield viscosimeter at 60° C. with a spindle No. 4 using a rotational speed of 100 revolutions per minute. On the other hand, if the dosage of the further modifying reagent is too high, the gelatinization of starch is prevented, which results in a decrease in viscosity. To achieve the desired improvements in a commercial cationic internal sizing starch, the proportion of the further modifying component in cationizing should be 0.05 to 0.5 g/kg of starch, calculated as an active agent.

EXAMPLE 3

The effect of the reagent prepared in example 1 on the viscosity of starch was studied.

1200 g of commercial potato starch was slurried into 1200 ml of water. The slurry was heated to 40° C. and its pH was raised up to 11 with a dilute NaOH solution. To the solution was added 58 g of a commercial cationizing reagent having an activity of 70% to which amounts mentioned in table below of the reagent prepared in example 1 (having an activity of 52%) had been added. The reaction was allowed to proceed for 24 h, whereafter it was neutralized, filtered and dried. In this way starches having an average cationicity were obtained with a viscosity given in Table below which were measured with a Brookfield viscosimeter at 60° C. with a spindle No. 4 using a rotational speed of 100 revolutions per minute.

| Further modifying reagent, g/kg | Viscosity mPas |
|---|---|
| 0 | 120 |
| 0.1 | 650 |
| 0.2 | 1200 |
| 0.4 | 1600 |
| 1.0 | 2200 |
| 1.7 | 690 |
| 2.9 | 175 |

EXAMPLE 4

This example discloses the dewatering properties of starches. The tests have been made in a laboratory with an SR apparatus.

In the tests, a 0.2% pulp suspension, diluted from the pulp of a fine paper machine, was used. The starches were dosed at a concentration of 1%, and the dosages were 0, 0.5, 1, 1.5, 2.0 and 3% of starch based on the dry matter of the pulp. The result obtained was the time (s) needed for the drainage of 900 ml. The degree of substitution of the starches was 0.035.

TABLE 2

| Dosage, % | Commercial product | New product |
|---|---|---|
| 0 | 27.2 s | 27.2 s |
| 0.5 | 27.4 s | 25.1 s |
| 1.0 | 27.9 s | 21.6 s |
| 1.5 | 28.9 s | 21.5 s |
| 2.0 | 31.0 s | 19.5 s |
| 3.0 | 32.2 s | 20.6 s |

It is seen that the dewatering properties of the product prepared in the new way are improved when the starch dosage is increased, whereas the opposite is true for the commercial product, which enables to increase the speed of a paper machine when the new type of starch is used.

EXAMPLE 5

Figure 1B:
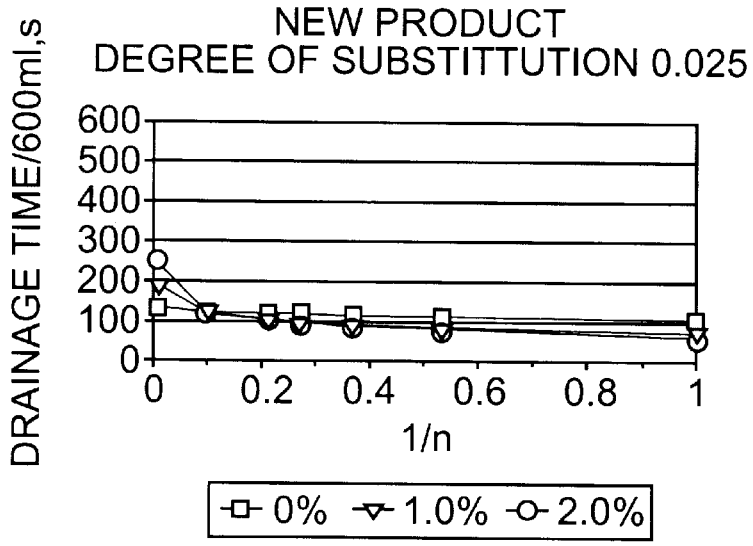
Figure 2A:
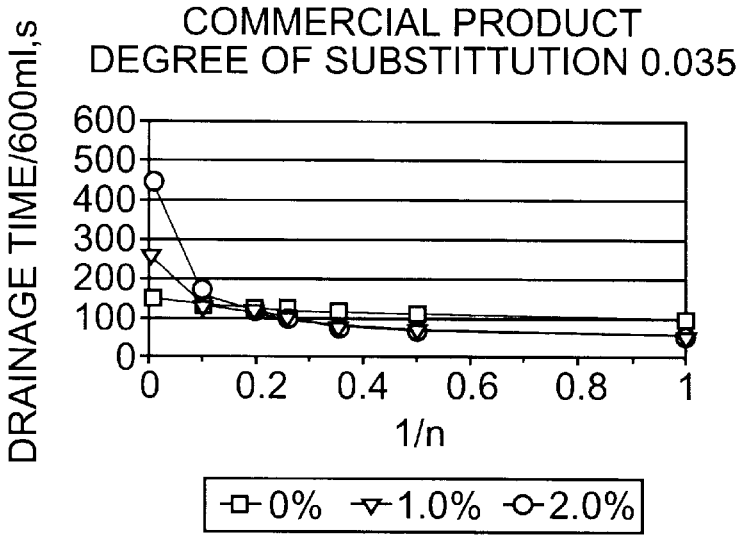
FIG. 2A PRIOR ART
Figure 2B:
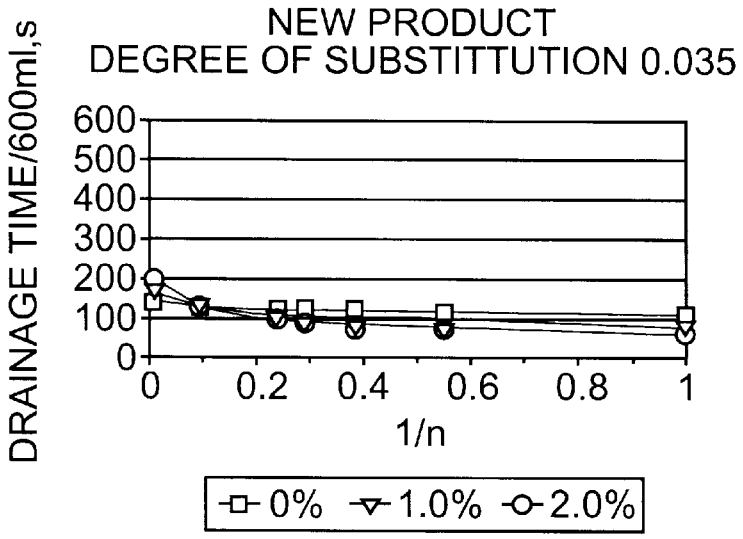
Figure 3A:
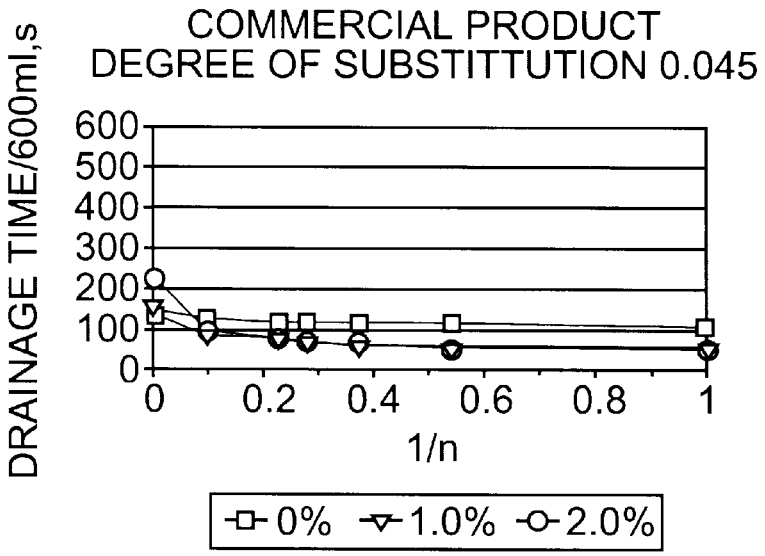
FIG. 3A PRIOR ART
Figure 3B:
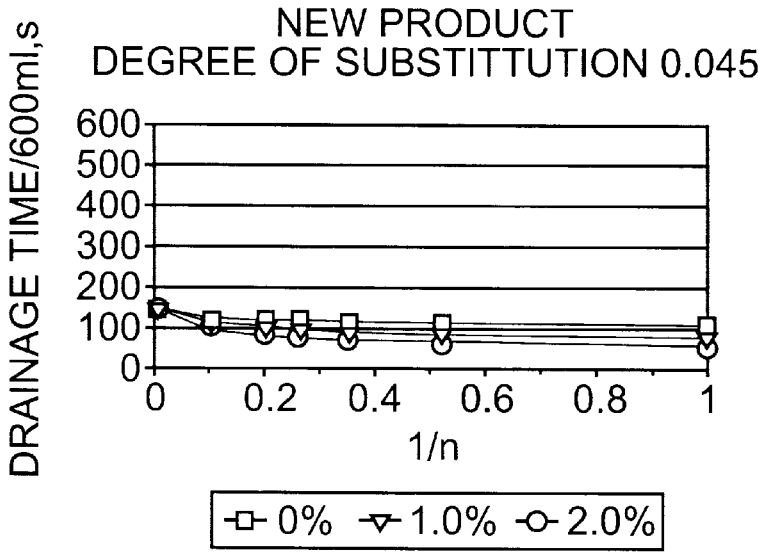

This example discloses dewatering tests with recirculated water, which tests were made with the device described in the previous example, by diluting the high consistency pulp with the filtrate from the previous test to the measurement concentration. In the tests water has been circulated seven times. The test pulp used in these tests was pulp from an LWC base paper machine. The results have been plotted in the FIGS. 1–3 as a function of the inverse of the circulation time, whereby zero is approached on the x-axis when the circulation times are increased.

From the results it is seen that with the commercial starches drainage becomes clearly far more difficult when circulation times are increased than with the products prepared in the new way, which shows the better dewatering properties of the internal sizing starches obtained in the new way.

EXAMPLE 6

This example shows the retention properties of the new internal sizing starches. The tests have been made with a pilot paper machine using LWC base paper furnish. Starch dosages used in the tests were 0, 0.5, 1.0, 1.5 and 3.0%. No other chemicals were used in addition to internal sizing starch. The degree of substitution of the starches was 0.025.

The starch contents analyzed from the paper are given in Table 3.

TABLE 3

| Dosage, % | Commercial product | New product |
|---|---|---|
| 0 | 0.1% | 0.1% |
| 0.5 | 0.5% | 0.6% |
| 1.0 | 0.9% | 1.0% |
| 1.5 | 1.2% | 1.3% |
| 3.0 | 1.7% | 2.3% |

From the results it is seen that the cationic starch obtained in the new way has a better retention in paper, whereby its strengthening effect is also increased due to the higher amount of starch in the paper.

EXAMPLE 7

In the test described in example 6, the turbidity of the wire water of paper machine was also studied which tells how much fines is carried with the water passing through the wire. In this case the degree of substitution of the starches was 0.035.

The turbidity as a function of starch dosage is given in Table 4.

TABLE 4

| Dosage, % | Commercial product | New product |
|---|---|---|
| 0 | 402 FTU | 402 FTU |
| 0.5 | 18.1 FTU | 15.8 FTU |
| 1.0 | 29.2 FTU | 17.1 FTU |
| 1.5 | 142 FTU | 28.9 FTU |
| 3.0 | 680 FTU | 125 FTU |

According to the results, the new product keeps the machine considerably cleaner. The difference is seen especially with larger doses. The starch obtained in the new way keeps the paper machine cleaner by removing anionic trash from the circulation water.

EXAMPLE 8

The most important reason for adding internal sizing starch to paper is its strengthening effect. The strengthening effect of starch is seen at its best in z-direction bonding power. In the pilot paper machine run described in examples 6 and 7, the z-direction bonding power was measured, which is shown in Table 5 as a function of starch dosage. The degree of substitution of the starches was 0.045.

TABLE 5

| Dosage, % | Commercial product | New product |
|---|---|---|
| 0 | 214 $J/m^2$ | 214 $J/m^2$ |
| 0.5 | 241 $J/m^2$ | 254 $J/m^2$ |
| 1.0 | 286 $J/m^2$ | 280 $J/m^2$ |
| 3.0 | 405 $J/m^2$ | 469 $J/m^2$ |

From the results it is seen that further modification does not affect the strength properties of the product prepared in a new way.

What is claimed is:

1. Method for paper manufacture on a paper machine having a wet-end, which comprises adding starch to a fibre stock in the wet-end, wherein said starch is a starch cationized with a chemical produced by using epichlorhydrin and trimethylamine, and in addition at least one of the members selected from the group consisting of monomethylamine, dimethylaminie and N,N,N',N'-tetramethylethylenediamine.

2. The method according to claim 1 wherein said starch is a starch cationized with a mixture which is obtained by adding to the reaction product of epichlorllydrin and trimethylamine, a reaction product of N,N,N',N'-tetramethylethylenediamine and epichlorhydrin.

3. The method according to claim 2, wherein a starch is used which is cationized with a cationizing chemical in which the molar ratio of the reaction between epichlorhydrin and N,N,N',N'-tetramethylethylenediamine has been between 1.5 and 3.0.

4. The method according to claim 3 wherein said molar ratio is about 2.3.

5. The method according to claim 3, wherein a starch is used which is cationized with a cationizing chemical produced by using N,N,N',N'-tetrarnethylethylenediamine and epichlorhydrin, where the proportion of the cationizing chemical is 0.005 to 0.1% of the amount of starch.

6. The method according to claim 3, wherein a starch is used which is cationized to a degree of substitution of 0.015 to 0.15.

7. The method according to claim 2, wherein a starch is used which is cationized with a cationizing chemical produced by using N,N,N',N'-tetramethylethylenediamine and epichlorhydrin, where the proportion of the cationizing chemical is 0.005 to 0.1% of the amount of starch.

8. The method according to claim 7, wherein a starch is used which is cationized to a degree of substitution of 0.015 to 0.15.

9. The method according to claim 2, wherein a starch is used which is cationized to a degree of substitution of 0.015 to 0.15.

10. The method according to claim 1, wherein a starch is used which is cationized to a degree of substitution of 0.015 to 0.15.

11. The method according to claim 1, wherein a starch is used which is dry cationized.

12. The method according to claims 1, wherein a starch is used, which is cooked to have a viscosity of over 1000 mpas measured with a Brookfield viscosimeter at 60° C. with a spindle No 4 using a rotational speed of 100 revolutions per minute in a 5% solution.

* * * * *